United States Patent [19]

O'Connor

[11] 4,280,344

[45] Jul. 28, 1981

[54] DEVICE FOR RINSING AND CLEANING A DRAG CLOTH

[76] Inventor: John D. O'Connor, 1817 Robin Hood, Sarasota, Fla. 33581

[21] Appl. No.: 87,578

[22] Filed: Oct. 22, 1979

[51] Int. Cl.[3] ..... D06F 1/12

[52] U.S. Cl. ..... 68/213; 15/264; 134/92; 134/135

[58] Field of Search ..... 68/213, 214, 235 R, 68/235 D, 197, 232, 237, 199; 15/257 R, 257.05, 257.06, 260–264; 134/92, 135, 201; 220/428, 408, 409, 410; 99/403, 413

[56] References Cited

U.S. PATENT DOCUMENTS

| | | | |
|---|---|---|---|
| 549,756 | 11/1895 | Van Horn et al. | 134/135 X |
| 1,374,338 | 4/1921 | Syverson | 15/261 X |
| 1,512,744 | 10/1924 | Calder | 15/264 |

FOREIGN PATENT DOCUMENTS

| | | | |
|---|---|---|---|
| 472699 | 8/1914 | France | 15/263 |
| 279640 | 11/1927 | United Kingdom | 15/264 |

*Primary Examiner*—Philip R. Coe

*Attorney, Agent, or Firm*—Barry L. Haley

[57] ABSTRACT

A drag cloth cleaning and rinsing device including a bucket-like receptacle, capable of bearing fluid, a box-shaped screen removably mounted within the opening of said bucket, the screen having sufficient depth to be received into the bucket so that a portion of the screen is immersed below the water level within the bucket, and a drag cloth squeezing and draining trough mounted on one side of the screen. The drag cloth is inserted below the fluid level in the bucket within the screen, the screen being used to compress the drag cloth repeatedly within the fluid medium in the bucket for cleaning the drag cloth. Once cleaned, the drag cloth is transferred to the trough where the fluid is squeezed out and largely removed from the cloth by compressing the cloth against the trough. The ends of the trough, or any portion thereof, are open to allow drainage back into the bucket.

3 Claims, 5 Drawing Figures

DEVICE FOR RINSING AND CLEANING A DRAG CLOTH

BACKGROUND OF THE INVENTION

This invention relates generally to a device that is useful to allow one using a drag cloth to thoroughly, yet efficiently and quickly, clean and rinse out the drag cloth during its usage.

The drag cloth, which is described in applicant's prior patent application U.S. Ser. No. 953,850, filed Oct. 23, 1978, is an implement useful in tile operations and especially tile cleaning which consists of a cloth connected to an elongated handle and is used to clean the surface of the tile. In order for the drag cloth to be effective, it is important that the residual materials from the tile surface be thoroughly cleansed from the drag cloth repeatedly.

The purpose of the present invention is to accomplish efficient and quick cleaning of the drag cloth and rinsing to allow one to more readily use the drag cloth during the tiling operation.

BRIEF DESCRIPTION OF THE INVENTION

A device useful for cleaning and rinsing out a drag cloth which comprises a large rectangular bucket having an open top mounted on rollers for movement of the bucket, an elongated, rectangularly-shaped screen box which is mounted within the bucket and connected on each side by a pair of threaded shafts to the upper edge opening of the bucket. Wing nuts may be included on the threaded shaft for affixing the screen to the bucket opening. Affixed on one side of the screen is an angled surface that is useful for squeezing and draining the drag cloth, the surface having an opening at each end to allow water to drain back into the bucket.

The screen itself may be constructed of rigid members in a rectangular box or frame with rigid metal screening attached on all sides, the top being open for receiving the drag cloth during the cleaning operation. The upper frame portion of the screen basket includes threaded shafts which are welded or formed as part of the upper frame which are received in grooves on parallel sides of the bucket which hold and support the entire screen frame across the opening of the bucket. The frame height would, in one embodiment, be approximately half the height of the bucket which allows it to be immersed within a fluid level near the top of the bucket to receive plenty of fluid (which is normally water or other cleaning solvents) for cleaning the cloth in the bucket. The screen is removable for storage and transport considerations of the receptacles so that the bucket can conceivably be used for other objectives with the screen removed.

The trough, which is attached to one side of the screen, is in effect a pair of surfaces angularly joined with one surface being parallel to the screen backing and having a pair of hook-like fasteners at the top for support against the top frame of the screen and a second angular surface somewhat horizontally disposed connected to the vertical surface. A rigid frame member across each end adds stability and strength to the unit, while the ends are open. Thus, the drag cloth is inserted into the two surfaces to the trough where it is compressed to allow water to drain out each end. The trough is mounted well above the water level of the device.

It is an object of this invention to provide an improved device that can be used for both cleaning and rinsing thoroughly of a drag cloth that is used in tile operations or other similar operations.

Another object of the invention is to provide drag cloth cleaning and draining devices which may efficiently employed and are non-complex in construction.

And yet, still another object of the invention is to allow or provide a useful device for cleaning and rinsing a drag cloth in which the drag cloth may be thoroughly cleaned and immersed in water or other cleaning solvents and then quickly drained.

In accordance with these and other objects which will be apparent hereinafter, the instant invention will now be described with particular reference to the accompanying drawings.

PREFERRED EMBODIMENT OF THE INVENTION

Figure 1:
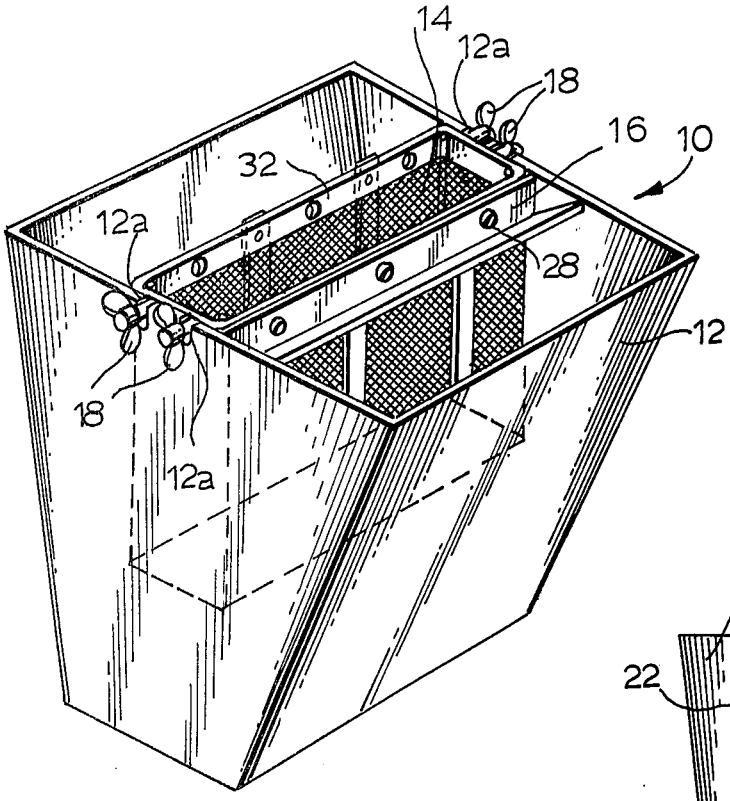
FIG. 1 shows a perspective view of the present invention.

Referring now to the drawings and specifically FIG. 1, the present invention is shown generally at 10 comprised of a rigid receptacle 12 which may be tapered in shape.

Mounted inside the rigid receptacle 12 is a rectangular screened enclosure 14 made up of frame members 32 and 30 (see FIG. 3) with a screen of a rigid metal disposed about the frame members. The screen has an open top to allow a drag cloth to be inserted therein. The upper frame 32 of the screen includes a pair of threaded shafts 20 which receive wing nuts 18 to allow the screen network to be mounted within the bucket 12 in grooves **12*a* along the upper lip of the opening of the bucket. This provides for firm support of the screen to withstand downward compression of the drag cloth on the screen itself. Mounted on one side of the screen is a trough 16** which is used to drain the drag cloth.

Figure 2:
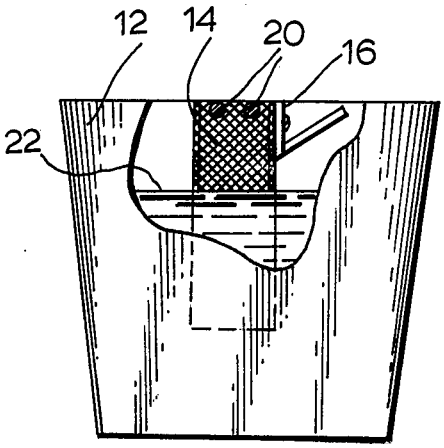
FIG. 2 is a side elevational view partially cut away showing the present invention.

FIG. 2 shows how the screen 14 may be mounted such that a large portion of the screen is within the fluid level in the bucket, the fluid being 22. Also is shown how the trough 16 is mounted above the fluid level so that the drag cloth may be drained.

Figure 3:
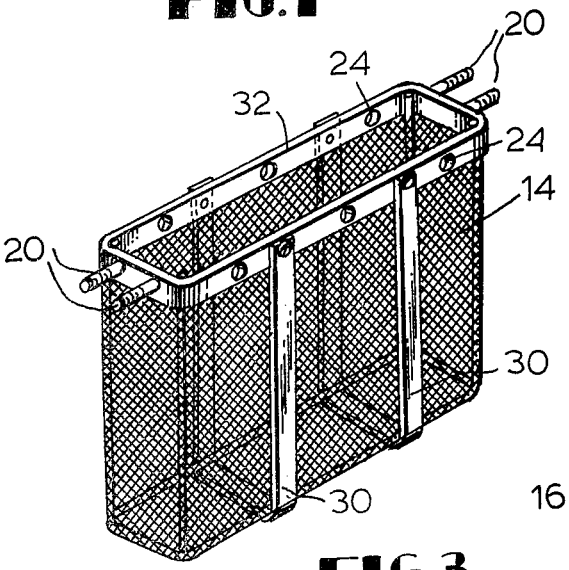
FIG. 3 shows a perspective view of the screen used in the present invention.

FIG. 3 shows the screen enclosure with an open top having an upper frame 32 and the vertical side members 30 forming a rectangularly shaped screen. The threaded shafts 20 may be welded to the upper frame 32. The screen 14 also covers the bottom surface which is not readily visible from FIG. 3.

Figure 4:
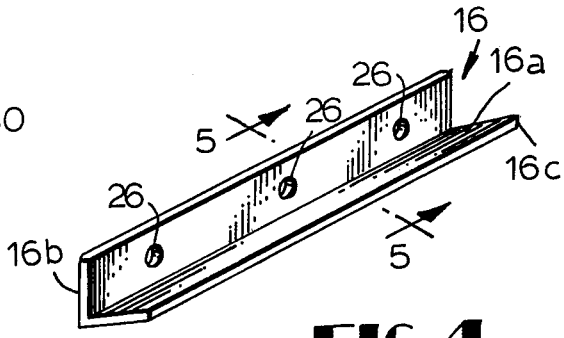
FIG. 4 shows a perspective view of the trough used in the present invention.

FIG. 4 shows the trough which includes surfaces **16*b* obliquely joined to a surface 16*c*. The end of the trough 16*a* is open on each side. A plurality of threaded fasteners 28 are firmly fixed through apertures 26 of trough wall 16*b* to frame 32 (through apertures 24) and allow the trough to be removably mounted on the upper frame 32** of the screen.

Figure 5:
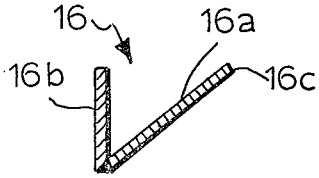
FIG. 5 shows a side elevational cross-section through line 5—5 of FIG. 4 showing the trough.

FIG. 5 shows a side view of the trough 16 with the open end.

In operation, the screen 14 is mounted as shown in FIG. 2 with sufficient fluid 22, such as water or cleaning solvent and water. The drag cloth on its handle would be inserted into the screen, compressed vigorously against the screen within the fluid to allow for thorough cleaning of the drag cloth. Once cleaned, the drag cloth is then lifted and deposited within the trough 16 against which it is compressed for removing and squeezing the water out of the drag cloth or other fluid. This operation may be repeated as desired.

For storage or using the receptacle 12 for other purposes, the wing nuts 18 may be loosened and the entire screen and trough removed. The tapered shape of the bucket may also allow it to be shipped in a stacked array or to be stored in a stacked array at a particular job site.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A device useful for cleaning and removing excess cleaning liquid from a drag cloth comprising:

a receptacle for holding a drag cloth cleaning liquid, said receptacle having side walls and a lip at the top of said side walls forming a top opening;

a rigid frame, said frame having a top portion that includes a plurality of rigid members forming an elongated rectangle that extends substantially across said receptacle top opening lip, said frame including side and lower members which extend substantially downward from the upper frame members, the length of said side frame members being such to extend substantially to the middle portion vertically of said receptacle;

a screen coupled to the side and lower members of said frame;

means for removably attaching said frame to the top opening lip of said receptacle; and a drag cloth receiving trough connected to the upper members of said frame along one side of said frame.

2. A device as in claim 1, including:

said means for attaching said frame to said receptacle including a pair of threaded shafts connected at each end of the top portion of said frame, said top opening lip of said receptacle including grooves for receiving said threaded shafts on said frame, and a plurality of nuts threadably receivable on said threaded shafts for locking said frame to said receptacle.

3. A device as in claim 2, including:

said drag cloth receiving trough includes first and second surfaces angularly connected together and first and second ends, the first and second ends of said trough being open.

* * * * *